US005623802A

United States Patent [19]

Boushek et al.

[11] Patent Number: 5,623,802

[45] Date of Patent: Apr. 29, 1997

[54] CONSTRUCTION TECHNOLOGY

[75] Inventors: Robert E. Boushek; Kalman R. Bundy, both of Worthington, Minn.

[73] Assignee: Bedford Industries, Inc., Worthington, Minn.

[21] Appl. No.: 268,294

[22] Filed: Jun. 30, 1994

[51] Int. Cl.[6] ..... E04D 1/00

[52] U.S. Cl. ..... 52/543; 52/58; 52/551

[58] Field of Search ..... 206/395–397, 206/409; 52/410, 417, 551, 543, 58; 428/316.6, 137, 131, 122, 127

[56] References Cited

U.S. PATENT DOCUMENTS

| | | | |
|---|---|---|---|
| 2,595,375 | 5/1952 | Weirich . | |
| 2,631,034 | 3/1953 | Eddy . | |
| 2,672,831 | 3/1954 | Fink et al. | 52/543 |
| 3,082,577 | 3/1963 | Fasolo et al. | 52/543 |
| 3,913,786 | 10/1975 | Kartasuk . | |
| 4,003,866 | 1/1977 | Paturle . | |
| 4,102,107 | 7/1978 | Barker et al. | 52/551 X |
| 4,368,604 | 1/1983 | Spielau . | |
| 4,453,634 | 6/1984 | Blumenthal . | |
| 4,731,970 | 3/1988 | Marshall et al. | 52/551 X |
| 4,736,562 | 4/1988 | Kelly . | |
| 4,844,373 | 7/1989 | Fike . | |
| 5,030,662 | 7/1991 | Banerjie . | |
| 5,037,685 | 8/1991 | Richards et al. | 52/549 X |
| 5,154,025 | 10/1992 | Brown | 52/58 |
| 5,242,736 | 9/1993 | Van Erden . | |
| 5,251,416 | 10/1993 | White . | |
| 5,284,247 | 2/1994 | Turner . | |
| 5,309,685 | 5/1994 | Rathgeber et al. | 52/58 |
| 5,469,671 | 11/1995 | Rathgeber et al. | 52/410 X |
| 5,471,807 | 12/1995 | Vasquez | 52/551 X |

*Primary Examiner*—Carl D. Friedman
*Assistant Examiner*—Beth Aubrey
*Attorney, Agent, or Firm*—Robert C. Baker

[57] ABSTRACT

A plastic construction strip in the form of a coil of overlapped convolutions has a composition comprised primarily of polyolefin material. It is between about 20 and 80 mils in thickness and has a width of at least one-half inch. It has high resistance to tearing and a tensile strength in excess of 1,000 psi, plus sufficient stiffness to support at least a 6-inch length of itself in upright, substantially vertical condition from a holding point and sufficient flexibility to be wound upon itself in overlapping convolutions as small as 1 inch internal diameter. The coil is ideally marketed as part of a dispenser package having a peripheral wall with exit and re-entry openings, and the outermost end of the coiled strip is threaded through the exit and then back into a re-entry opening so as to lie loosely within the container but be easily withdrawn therefrom. Roofing use of this strip involves fastening the strip over edge portions of roofing felt in much the same manner that wood lath has heretofore been used to hold the easily tearable roofing felt against tearing damage caused by wind uplift forces. The new plastic strip is embedded and locked within the roofing structure under the lapped finish roofing layer of shingles.

36 Claims, 3 Drawing Sheets

CONSTRUCTION TECHNOLOGY

BACKGROUND OF THE INVENTION

This invention relates to construction technology, and particularly to a new plastic strip article and dispenser package as well as to a new method of roofing and new roofing structures formed using the plastic strip article. The invention provides a recycling use for plastic waste.

As plastic products have become ubiquitous, the amount of plastic waste has grown to intolerable levels for landfill disposal. Amongst the most popular of plastics for a multitude of consumer products (e.g., bottles, bags, cartons, etc.) are the polyolefins, including polyethylene. One recycling use for waste polyolefin plastic is as a substitute for lumber. Illustratively, Banerjie U.S. Pat. No. 5,030,662 of Jul. 9, 1991 directs itself to lumber formed by extrusion of waste polyolefin compositions. The plastic waste compositions heretofore extruded into lumber shapes (such as two-by-fours and four-by-fours) has not only included the compositions specifically recited in the Banerjie patent, but also has included waste polyolefin compositions containing cellulose fillers formed from wood-derived waste such as paper. A desirable property of waste polyolefin plastic lumber is its high resistance to biodegradation, which is the very property that makes landfill disposal of polyolefins unattractive. The problem with known plastic lumber, however, is that its storage and portability is much the same as the storage and portability of standard wood lumber. Compactness for storage and shipment is not its greatest attribute. Greater convenience for the storage and shipment and handling of plastic construction products is desired and necessary for an expanding construction use of polyolefin plastic.

SUMMARY OF THE INVENTION

The present invention provides a new plastic strip article for construction uses. Plastic strips of the invention can be used as a substitute for wood lath. The new plastic strip is ideally manufactured using waste plastic and is formed into a compact coil. The coiled plastic strips of the invention are far more versatile as construction articles than wood lath. They are much more compactable and easily stored and shipped and handled in use.

The invention especially provides a compact package article for storing and shipping and dispensing the new plastic construction strip. This package article comprises a container having within it a coil of overlapped convolutions of the plastic construction strip. The strip is comprised primarily of polyolefin material, preferably waste polyolefin material, and is more than 100 feet in length. It in fact has an indefinite length that is so long that an equivalent length of wood lath would have many times greater bulk than the product of this invention.

The coiled strip has a thickness between about 20 and 80 mils and a width of at least one-half inch. Its structural integrity is such that it has sufficient resistance to tearing to be substantially untearable under opposing hand forces applied perpendicular to its thickness at an edge starting cut and has sufficient toughness to exhibit a tensile strength in excess of 1,000 psi when tested in accordance with ASTM:D882-91. Additionally, it has sufficient stiffness to support at least a 6-inch length of itself in upright substantially vertical condition from a holding point and nevertheless has sufficient flexibility to be wound upon itself in overlapping convolutions as small as 1 inch internal diameter. As an article of manufacture, however, the innermost convolution of the coil in the new package article should have an internal diameter not more than about 3 inches, although smaller internal diameters are preferred. The outermost convolution of the coil should have an external diameter in excess of about 10 inches. Coils having great lengths of the plastic strip are easily handled in use applications.

The container itself has a planar top and bottom wall in substantially flush condition on opposite sides of the coil and has a peripheral wall perpendicularly connecting the top and bottom walls together. It is the peripheral wall that has an exit opening capable of functioning as an exit for lengths of the plastic strip pulled from the coil within the container.

Ideally, the container is provided with a pair of openings in the nature of slots, and the slots are in spaced relationship. One of the slots is an exit slot and the other an entry or re-entry slot. The outermost end of the length of plastic strip within the container is threaded to the exterior of the container through the exit slot and then is threaded back through the entry slot so that the outermost end lies loosely within the container. This causes a stretch or length of plastic strip to extend exteriorly of the container between the exit and entry slots for easy hand gripping to pull the outermost end of the strip from the interior of the container and then pull additional length of the strip through the exit slot to cause unwinding of the strip from the coil within the container.

The convenience of the compact plastic strip package article of the invention is particularly noteworthy in roofing applications. Underlayments of asphalt-impregnated felt need protection against wind damage (e.g., wind tearing) after they are applied and before the shingling operation is completed. By fastening the new construction strip of the invention along overlaps of sections of the underlying felt, such protection is provided; but this is not the only benefit when the new strip of the invention is used. Wood lath has heretofore been employed for this very same purpose. The big advantage when the strip of this invention is affixed to protect asphalt-impregnated felt against wind damage during the time it is exposed before the shingle operation is completed lies in the fact that the extra step of removing wooden lath before completing the shingling operation is totally avoidable. Shingling may be accomplished directly over the protective plastic strips of this invention.

Still other benefits and advantages and features of the invention will become evident as this description proceeds.

DESCRIPTION OF THE PREFERRED EMBODIMENT

Figure 1:
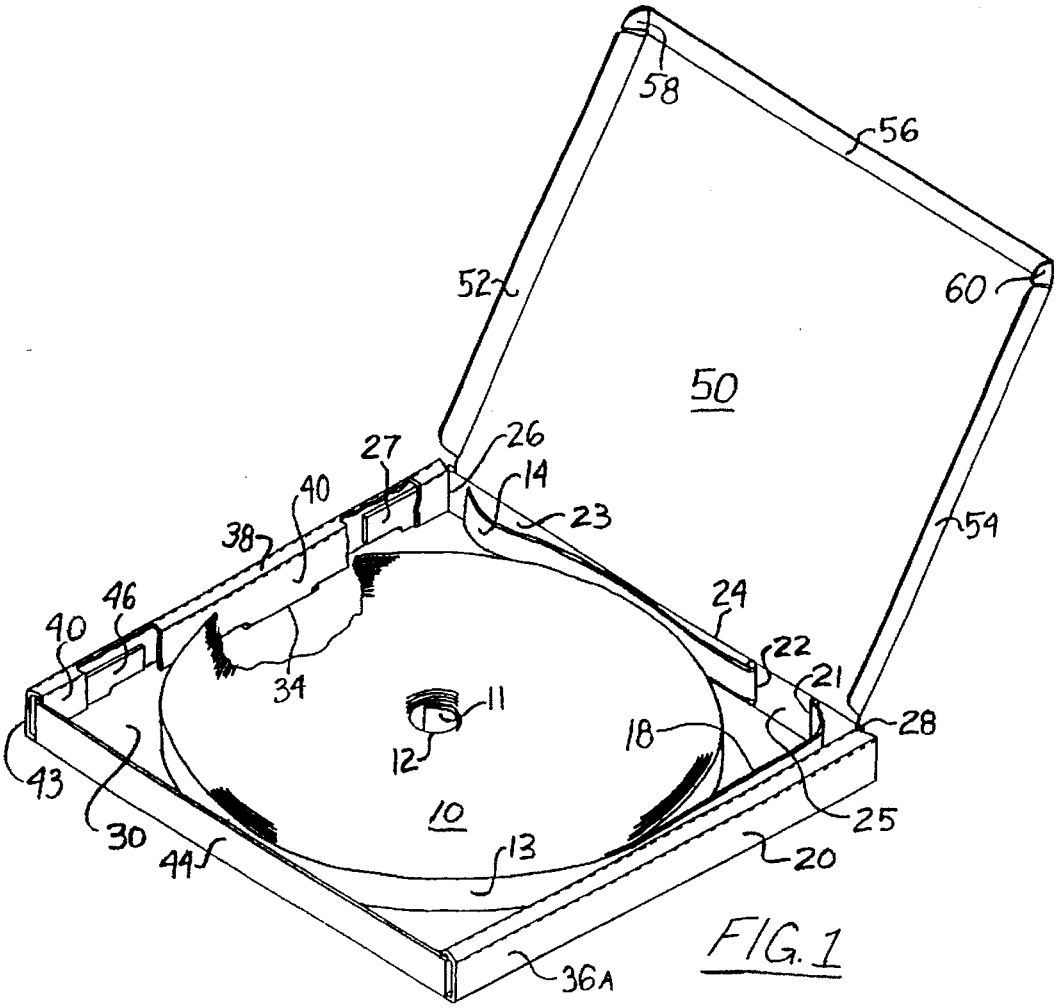
FIG. 1 is a schematic perspective view of a new compact package article formed in accordance with one aspect of the invention, with the container in opened condition to show internal features.

Referring to FIG. 1, the new compact package article has a coil 10 of plastic construction strip within an exterior container 20. The coil is comprised of overlapping convolutions of the plastic construction strip. The innermost end 11 of the strip is at the innermost convolution 12, and this convolution may have an internal diameter less than 1 inch, and possibly even as small as ½ inch. The flexibility of the construction strip is such that it can be wound in an overlapping convolution as small as about 1 inch and even as small as about ½ inch internal diameter. In terms of marketing the new package of the invention, however, somewhat larger internal diameters may be employed, but the compactness feature of the invention requires that the internal diameter should never exceed about 3 inches, and preferably should not exceed about 2 inches or even 1 inch.

The outermost convolution 13 for the strip has an external diameter in excess of about 10 inches and generally will be around 12 inches, maybe larger. A major benefit of the invention lies in the fact that the exceedingly compact package can contain extraordinary lengths of the new construction strip, even lengths in excess of 200 feet, or even more than 300 or 400 feet. A length of strip of about 270 feet is rather ideal for strips about 30 mils thick. A 30-mil thick strip permits the formation of approximately one foot square package articles (or packages articles fractionally larger than one square foot) with coils closely approaching or equalling about one foot in diameter. Even when the strip is formed to be up to 80 mils in thickness, great lengths of it, well over 100 feet, can be compactly packaged using coils not exceeding about 18 or 20 inches in diameter.

The new plastic construction strip is comprised primarily of polyolefin material, especially waste polyolefin material, and that will be discussed further hereinbelow. At this point, it is emphasized that the new strip is polymeric and thermoplastic and is substantially uniform in thickness. Its plastic thickness is between about 20 and 80 mils, with a thickness of about 30 mils, plus or minus about 5 mils, being exceedingly useful and illustrative of one of the most preferred substantially uniformly thick construction strips of the invention. In general, a thickness of 25 mils up to about 50 mils is in the range considered most versatile for lath-like lumber uses. The range of thickness—between about 20 and 80 mils—together with the nature of the composition (i.e., the plastic itself and the ingredients mixed with it) is such as to impart sufficient stiffness or structural integrity to the strip at room temperature (e.g., about 70° F.) so that it will support at least a 6-inch length of itself in upright vertical condition from a holding point. Even 8-inch lengths of the more ideal strips can be supported in upright substantially vertical condition from a holding point. But this feature of stiffness is combined with sufficient flexibility so that the strip can be wound in overlapping convolutions as previously mentioned.

A still further feature of the structural integrity of the strip is that it has desirably high tear resistance. It is substantially untearable under opposing hand forces applied perpendicular to its thickness, even when those forces are applied at an edge starting cut or notch in the side of the strip. This is not to say tearing cannot be accomplished using mechanical aids. It is to say that this new plastic construction strip does not behave like many films or tapes of plastic (e.g., "Saran" and "Mylar" film and also cellophane) which are easily torn by hand, and especially easy to tear by hand once a tear or split or cut is started. Even a cut or split or tear mechanically started in this new construction strip does not present an easy opportunity to continue the severance (i.e., tear) by mere opposing hand-applied forces. Further, this new strip is tough and non-rubbery (i.e., lacking springy elasticity). These features bearing on toughness can be summed up in tensile strength, that is, the maximum engineering stress, in tension, that can be sustained without fracture. The toughness is such that the strip exhibits a tensile strength in excess of 1,000 psi (and generally in excess of 1,200 psi or even 1,400 psi) under room temperature conditions or when tested under standard ASTM:D882-91 test conditions. All of these features are valuable, but it is these combined with flexibility that permit the strip to perform structural construction functions and yet be wound in tight overlapping convolutions with adjacent surfaces in intimate contact for compactness during shipment and storage and on-site handling.

The usefulness of the strip in construction applications requires it to have a width of plastic of at least one-half inch and usually at least about 1 inch, and generally not over about 12 inches. The ideal widths for lath substitute uses fall between about 1 and 3 inches, with widths between about 1 and 2 inches and particularly at about 1¼inches or 1½inches being exceedingly useful. As the width is increased up to about 5 inches, or 8 or 10 or 12 inches, the construction uses vary, with the wider widths being versatile for use in valley portions of roofing.

The container of the new package article has a planar bottom wall 30 and a planar top wall or cover 50. These walls are in substantially flush condition on opposite sides of the coil within the container. In a sense, these walls serve as outer flanges for the coil of overlapped convolutions of the packaged plastic strip. Interestingly, however, no flanges are in fact needed, and no core is needed, which contributes to the simplicity of the compact package article. Extending between the top and bottom walls of the package article is a peripheral wall. Illustratively, the rear wall 23 is a peripheral wall and perpendicularly connects the top 50 and bottom 30 walls together. This peripheral rear wall 23 has an exit opening or slot 21 capable of functioning as a dispensing exit for lengths of the plastic strip pulled from the coil 10 within the container 20.

Figure 5:
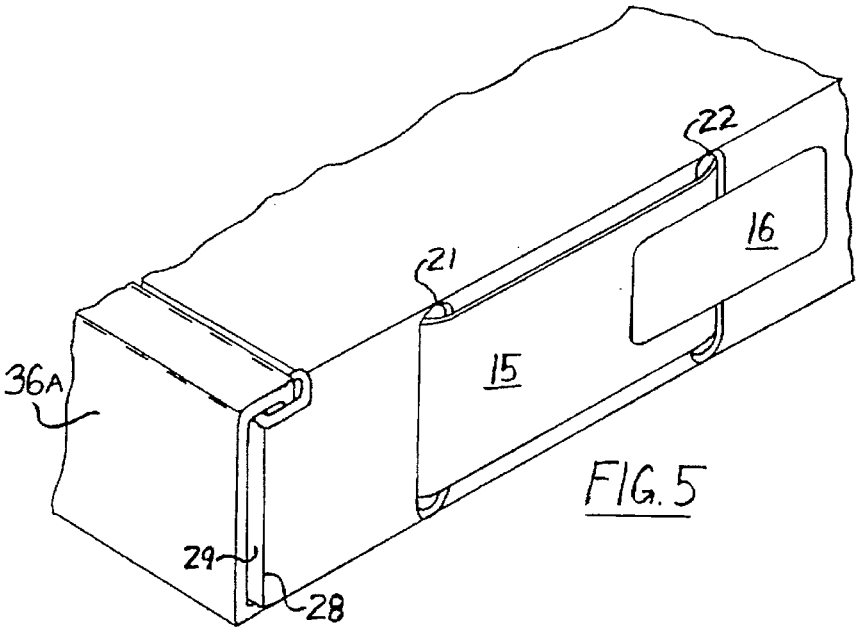
FIG. 5 is a schematic perspective view of the rear panel of the compact package article illustrating a small section of removable normally tacky and pressure-sensitive adhesive tape in bridging condition over an exposed portion of construction strip on the exterior of the package and a portion of the rear peripheral wall or panel of the package article.

The ideal container has two slots 21, 22, and its rear panel 23 is appropriately called a planar peripheral dispensing wall. This rear panel or planar peripheral dispensing wall 23 has opposite terminal ends 26, 28 and a pair of parallel slots 21, 22 extending through it. Both slots are aligned in the axial direction of the coil (i.e., aligned in parallel fashion with the axis of the coil). The slots are in spaced relationship to each other and also are in spaced relationship from each terminal end 26, 28 of the dispensing wall. As illustrated (see FIGS. 1, 2, and 5), these slots 21, 22 in every instance have a width greater than the thickness of the plastic strip of the compact package article. Preferably each has a width at least twice (or even at least three or four times) the thickness of the plastic strip, up to a width possibly even 10 times the thickness of the plastic strip. Wide slots permit easy movement of the strip through the slots, which is important for maximum benefit of the invention.

The outermost end of the plastic strip extends from the coil within the container and is threaded through the exit slot 21 of the pair of slots and then back through the other slot or entry slot 22 (or re-entry slot 22) so that the outermost end ends up lying loosely within the container as the packaged article is marketed in commerce. An especially important feature of the product as it is marketed in commerce in its preferred form is that an exterior stretch 15 of the plastic strip extends between the exit 21 and entry 22 slots (see FIG. 5). This exterior stretch is easily hand gripped to pull the outermost end of the strip from the interior of the container and then pull additional length of the strip through the exit slot to cause unwinding of the strip from the coil within the container.

It is significant that both slots are spaced from the corners or edges of the box container. This permits the outer end section of the strip within the container to be curved gradually before it passes through the exit slot, and this—in combination with the relatively wide opening for the slots—facilitates maintaining the exterior stretch in substantially flat or flush condition against the exterior of the rear peripheral panel 23 after the outermost end of the strip is threaded, much as a belt is threaded through a belt loop, back into the interior of the container. A short stretch of pressure-sensitive adhesive tape 16, suitably labeled: "To Start Roll, Pull Here" may be affixed to bridge between the exterior exposed portion 15 of the strip and the outer surface of the rear panel 23, thereby to hold the exposed part 15 against unwanted accidental pulling away from the rear dispensing panel. The modestly stiff character of the strip also contributes to maintaining the exteriorly disposed section 15 closely adjacent to the rear peripheral dispensing wall, and this is further facilitated by the ample widths for the slots 21, 22 and the careful spacing of the slots 21, 22 away from the corner 28 as well as from each other. All of these features contribute to maintaining the exterior portion 15 of the strip in substantially straight condition parallel with the exterior surface of the rear panel 23. Ideally, the exit slot 21 is spaced from the corner 28 of the container at least about an inch and preferably between about 1 and 5 inches. The re-entry slot 22 is spaced even further from the corner 28 nearest the exit slot 21, and is spaced from the exit slot itself at least about 1 inch, or between about 1 and 4 inches, preferably about 2 or 3 inches. The re-entry slot 22 is also spaced from the corner nearest it, and this spacing is equal to or greater than the spacing of exit slot 21 from corner 28.

An especially important feature is that of the rethreading of the very outermost end or free end of the strip back into the interior of the package. This feature contributes to an entirely new order of convenience for the user. There is no need for the user to engage in what normally would be considered the opening of a package, and fishing for the end of a coil. All the user must do is pull on the exposed section or portion 15 of the strip, thereby removing the outermost end 14 from the interior of the package and permitting the removal of other portions of the strip from the interior coil simply by pulling lengths of the strip through the exit slot.

Ideally, both the top 50 and bottom 30 walls and peripheral wall 23 of the container are formed from a single blank of paperboard. A fold line 24 in the paperboard defines where the peripheral wall 23 connects to the top wall 50; and another fold line 25 in the paperboard defines where the peripheral wall 23 connects to the bottom wall 30. Corrugated paperboard is preferred for the reason of its high strength and relatively lighter weight as compared to solid paperboard of the same strength.

Figure 2:
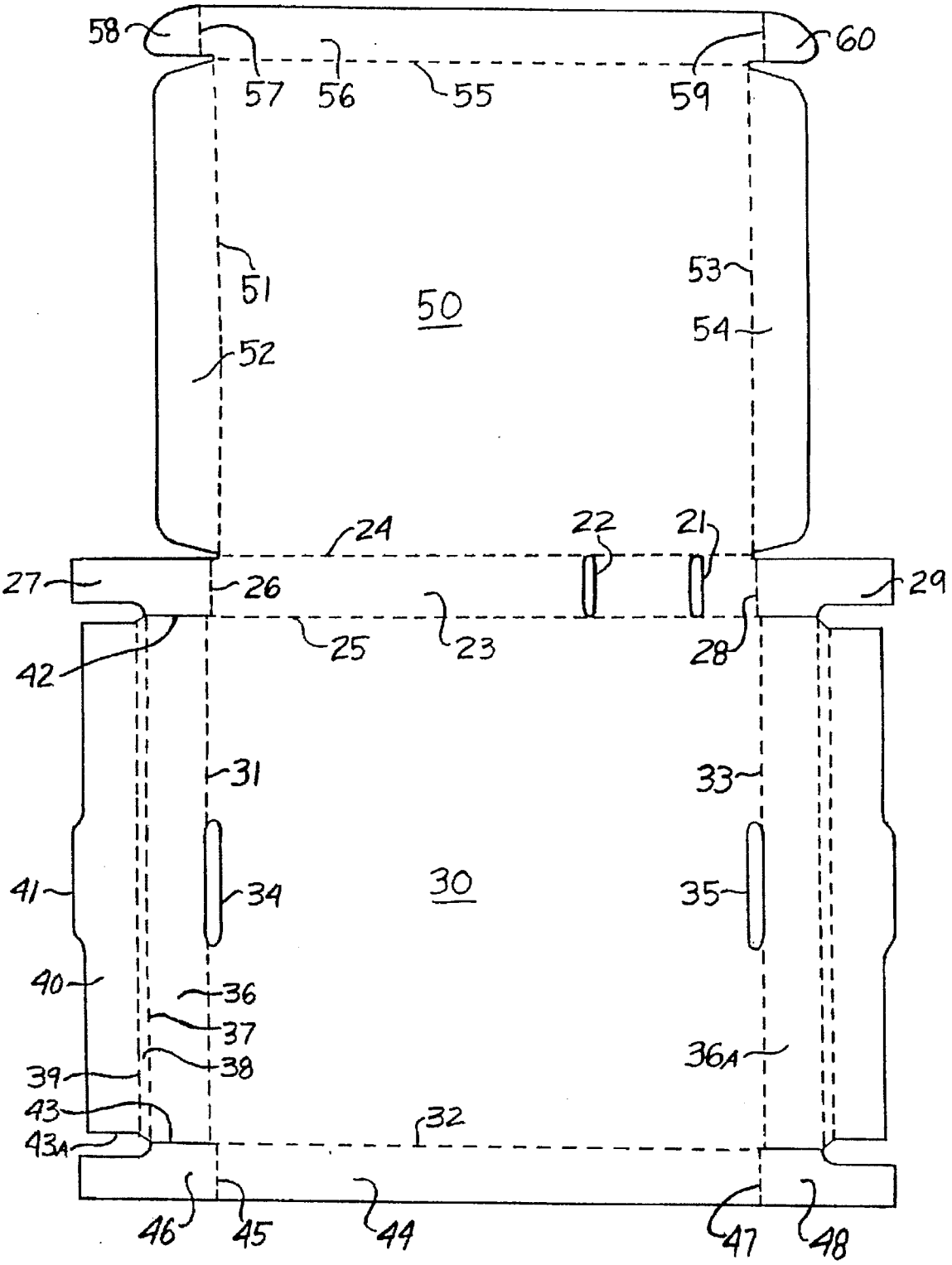
FIG. 2 is a plane view of a blank of paperboard having the design and fold lines useful for forming the container portion of the new compact package article.

The entire container may be and is preferably formed from a single blank of paperboard, as illustrated in FIG. 2.

The bottom panel for forming the bottom wall 30 of the container is defined by front 32 and rear 25 borders and left 31 and right 33 side borders. Each such border is a crease line or a line of fold. (Crease lines or lines of fold may be formed without as well as with spaced small cuts or score lines or lines of perforation or lines of some other type of optional weakening of the paperboard to facilitate its folding at such lines. Weakening at a fold line is optional.) The bottom wall 30 is equipped with a tab receiving slot 34, 35 along each side border. These slots extend parallel to and lie immediately adjacent to and at a medial location next to the side border lines 31, 33.

An upright front panel or front edge panel 44 for forming the front interior peripheral wall of the container 20 is united to the bottom panel at the front crease line 32. This front panel 44 has a length fractionally less than the side 31 to side 33 length (or width) of the front border 32 of the bottom panel. The front border 32 of the bottom panel 30 extends between the left 31 and right 33 side borders of it. Extending laterally outward from the laterally elongated front panel are support tabs 46, 48. The support tabs 46, 48 are connected or united to each lateral end of the front panel along a crease line 45, 47.

A rear panel 23 for forming the planar peripheral rear dispensing wall of the container is connected to the rear border or crease line 25 of the bottom panel 30. This rear panel 23 has a lateral length substantially equal to the length of the front panel 44—i.e., the rear panel 23 has a length fractionally less than the length of the rear border 25 of the bottom panel 30. To be noted is that the bottom panel 30 has a substantially square configuration such that the front border 32 is substantially equal to the rear border 25 of it, and the left side border 31 is substantially equal to the right side border 33 of it. The rear panel 23 has connected to each lateral end of it a support tab 27, 29 similar to the support tabs 46, 48 connected to each lateral end of the front panel. A crease line 26, 28 between the support tab 27, 29 at the lateral ends of the rear panel identifies the lateral end of the rear panel 23 and the start of a support tab 27, 29.

Sturdy lateral peripheral side walls, perpendicularly oriented to the bottom wall 30, are formed by folding lateral panel features connected along the side borders 31, 33 of the bottom panel. The structures along each opposing side of the bottom panel 30 are mirror images of each other, and therefore detailed description will concentrate on the structure at the left of the bottom panel 30 as illustrated in FIG. 2. Along crease line 31 extends an exterior side panel 36. Then a crease line 37 separates that exterior side panel 36 from the top edge 38 between the exterior side panel 36 and the interior side panel 40. Crease lines 37, 39 parallel to the side border crease line 31 of the bottom panel distinguish or separate the interior 40 and exterior 36 side panels from the top edge 38. Then a locking tab 41 extends medially outward from the interior side panel for insertion into tab slot 34 when the step of folding and forming the lateral peripheral side panels into a box structure is conducted. To be noted is that cuts 42 and 43 separate the front end and rear end, respectively, of the exterior side panel 36 from tabs 27 and 46. The front end 43A of interior side panel 40 (and also its rear end) is spaced slightly inwardly from the adjacent front end (and rear end) of the exterior panel 36.

A substantially square top panel 50 is for forming the top wall of the container. This top panel has a rear border defined by the crease line 24 connecting it to the rear peripheral panel 23. The front border 55 of the top panel has a side-to-side length equal to the side-to-side length of the rear border 23 of it. The front border 55 crease line connects the front edge flap 56 to top panel 50.

The front peripheral edge flap 56 (which forms the exterior front panel for the container) has a lateral length (between its lateral ends 57, 59) slightly greater than the length of the front border crease line 55 for the top panel. To each end 57, 59 of the front flap 56 is connected a tongue 58, 60; and the border between such tongues and the front flap 56 is defined by the lateral end crease lines 57, 59.

Also united to the top panel 50 are lateral tuck flaps or lateral peripheral edge tuck flaps 52, 54. The lateral tuck flaps 52, 54 at the left and the right of the top panel 50 are connected to the left and right side borders of the top panel along the crease line 51, 53.

(Illustratively, a useful container formed from the blank as illustrated has front and rear borders and side-to-side borders for its top panel of approximately equal length, such as about 12¼inches, whereas the front and rear borders for its bottom panel are almost 13 inches in length as compared to its side-to-side borders for its bottom panel of slightly more than approximately 1 foot in length.)

The folding of the blank illustrated in FIG. 2 to form the container illustrated in FIG. 1 (and also illustrated in part in FIGS. 3–5 inclusive) is accomplished as follows: The front support tabs 46, 48 at the ends of front panel 44 are folded at their crease lines 45, 47 to project vertically upward from front panel 44; and similarly, the rear support tabs 27, 29 are folded at their crease lines 26, 28 to project vertically upward from the rear panel 23. Rear panel 23 is folded along crease line 25 and front panel 44 along crease line 32 so that both project vertically upward from bottom panel 30. This in turn causes the front support tabs 46, 48 and the rear support tabs 27, 29 to lie interiorly of but adjacent the side crease lines 31, 33 at the side edges of the bottom panel. Exterior side panel 36 is folded along left side crease line 31 to project vertically up from bottom panel 30. Then top edge 38 is folded along crease line 37 to project vertically parallel with bottom panel 30. This places interior panel 40 also parallel over bottom panel 30. Then interior panel 40 is folded along crease line 39 downwardly. This action causes the support tabs 46, 48 at the ends of the front panel 44 and the support tabs 27, 29 at the ends of the rear panel 23 to be locked or lodged within the space between the exterior side panel 36 and interior side panel 40. Then the locking tab 41 is lodged in the bottom panel left side slot 34, which holds the left peripheral wall for the container in proper position as illustrated in FIG. 1. The right peripheral wall, being a mirror image, is similarly formed.

Then the coil of plastic construction strip is placed in the bottom part on the bottom panel 30 and the outermost end 14 pulled from the coil (in counterclockwise orientation as illustrated in FIG. 1). The outermost end is threaded out slot 21 and back in through slot 22 so that the outermost end of the strip lies within the bottom box portion of the container, but a small section 15 extends on the exterior surface of the rear panel 23 (see FIG. 5).

Figure 3:
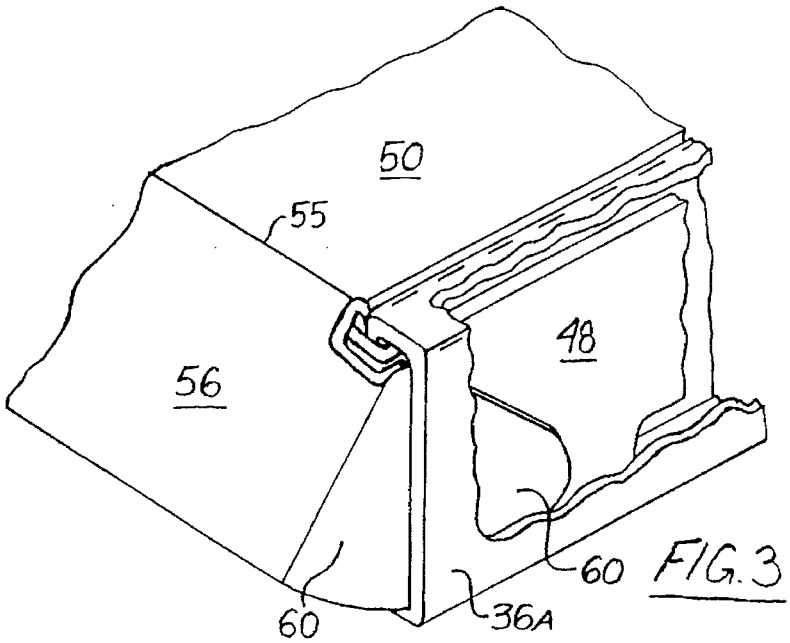
FIG. 3 is a schematic perspective view of a corner portion of the new compact package article, with parts broken away, showing the cover or top wall panel in closed condition and showing the front edge flap of the cover with its tongue portions partially inserted into the recesses for receiving the same.
Figure 4:
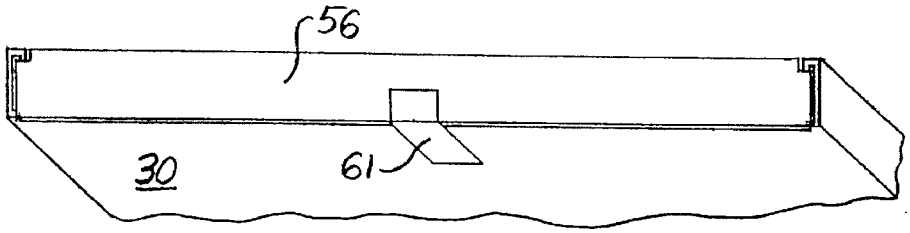
FIG. 4 is a schematic perspective view of a fragment of the new compact package article, showing the use of a small section of tape to hold the front edge flap solidly in place on the container and in effect seal the container against easy opening (since there is no need to open the container once the complete compact package has been assembled)

Thereafter, the lateral tuck flaps 52, 54 at each side of the top panel 50 are folded to project vertically from top panel 50 so that they will fit within the bottom box portion at a location adjacent to and interiorly of the interior side panels (e.g., with left tuck panel 52 interiorly of left interior side panel 36 of the bottom 30). The front peripheral edge flap 56 then is folded along its crease line 55 to be flush over or exterior to the front panel 44 of the bottom box portion for the container. However, before this last fold is made, the lateral tongues 58, 60 at each end of the front edge flap are folded at their crease lines 57, 59 so that, as the front edge flap 56 is folded downwardly to a position flush over the front panel 44 of the bottom box portion, the tongues 58, 60 at each end of the front edge flap 56 are slipped into the recess between the front panel end support tabs 46, 48 and their respective exterior side panels 36, 36A at each side of the bottom panel 30. (This is illustrated in FIG. 3, where tongue 60 is shown sliding into the recess between front support tab 48 and right exterior side panel 36A of the bottom box part of the container.)

Since no need exists for thereafter opening the container to gain access to the strip of coiled plastic material, it is convenient to fix the front edge flap 56 in flush condition over the front panel of the container by using a small strip of adhesive material 61, suitably a normally tacky and pressure-sensitive adhesive tape. The strip of adhesive tape 61 may be glass-fiber reinforced, but this is not critical. Other means (e.g., mechanical) for holding the front flap 56 against the bottom box front panel 44 may be employed, although adhesive holding (e.g., by spot or tape) is preferred.

Of note is the fact that the entire package article is easily formed without the necessity of using any metal staples. No center opening for the package article is needed.

The thermoplastic polymeric materials out of which the strip may be formed (e.g., by extrusion, rolling, etc.) include waste materials or recycled materials, and particularly include the popular variety of plastics embraced by the term "polyolefins". Probably the most popular polyolefins (in terms of their high volume of usage for consumer products) are those formed by homopolymerization of ethylene monomers or copolymerization of ethylene monomers with other monomers. Such polyolefins are appropriately called ethylenic polyolefins. Polyethylene itself, in one form or another (such as high or low density, high or low molecular weight, or some other modified form) is one example. Also embraced by the term "ethylenic polyolefins" are ethylene acrylic acid copolymers, ethylene acrylate copolymers, ethylene vinyl acetate copolymers, and various other copolymers or terpolymers with an ethylene content. These ethylenic polyolefins as well as the other polyolefins (e.g., polypropylene being an example of a non-ethylenic polyolefin of significant commercial use) have a life after their first uses. They are not commonly biodegradable, and it is this very property that makes them good recyclable products that serve as ideal starting waste ingredients for forming the plastic strip of this invention. Further, small amounts of a variety of other plastics (e.g., polyesters, polyamides, and almost an infinite variety of still other thermoplastic non-polyolefins) may be added to or present in recycled or previously used compositions useful for practicing this invention. They generally should not be present in amounts over about 20 percent by weight and for the most part their presence, if they are used, will be below 10 percent by weight or very minor or even insignificant, particularly as compared to the polyolefin content. Compatibility of the plastics in the polyolefin mass is a desirable property so as to achieve good blending, and lack of notable phase separation between different plastics if present in the mixture. Thus, when non-polyolefins are present, it is desirable to employ compatibilizers to cause the non-polyolefins to blend and not phase separate from the polyolefins. The variable nature of waste plastic materials employed as starting materials can mean that some components may be present that might well be totally avoided were one to use virgin material to form the plastic strip. Thus, compatibilizers and processing modifiers are desirably added to recycled mixtures, although sometimes they may be present as part of the waste plastic employed as a starting material. Fillers are another component and may include strand or filament fragments or particles of other materials such as metal which were present in a plastic that is being recycled. Various minerals and inorganic salts or oxides or flakes may be present as fillers or modifiers. The strip does not have any continuous length of wire or the like extending in the length dimension of it. Coloring agents, both organic and inorganic, may be employed. (Iron oxide is especially desirable for the brown color.) Coloring agents will rarely be employed in amounts over about 3 percent by weight, and most such agents (such as carbon black) do an effective coloring job when present in amounts up to about 1 percent by weight. Probably the most significant filler that is optionally used from zero up to about 20 or even possibly 25 percent by weight of the composition is cellulose in one form or another, particularly wood cellulose or wood-derived cellulose. Apart from saw dust or wood chips, one of the more interesting cellulose fillers is paper (i.e., paper made from wood pulp). The waste paper content of the strip of this invention will generally arise, however, from use of waste plastic that has the paper embedded in or bonded or attached to it.

The dominance of polyolefin plastic in the strip is so great that the strip is characterized as being or comprised primarily of polyolefin. At least 50 percent by weight of the strip is accounted for by polyolefins, preferably ethylenic polyolefins. Usually the polyolefin content will account for at least about 70 weight percent of the strip. In fact, the polyolefin plastic content generally will exceed 75 or even 80 percent of the weight of the strip, and preferably will be even higher, exceeding about 85 or 90 percent of the weight of the strip. Non-polyolefin plastics are not preferred but may account for zero percent up to about 20 percent by weight. Non-plastic ingredients, if present, are in particulate form, and the particles have a thickness no greater than the thickness of the strip. The dimensions other than thickness will not exceed about ⅜ inch in size. Usually such particulates will be below 3/16 inch in size in all dimensions, down to the submicron size. Generally the non-plastic ingredients will be kept below 20 weight percent at the maximum, and preferably below or up to about 15 weight percent—with non-plastic contents not over about 10 percent by weight being most preferred. As the presence of nonplastics increases, and as the content of non-polyolefin plastic increases, the tendency is for the tensile strength of the resulting strip to decrease. Approximations of ingredients and the weight percent thereof are necessarily employed in describing the composition because of the nature of, and the variations in, the waste materials which are useful to form the composition.

Manufacture of the strip using plastic wastes generally starts with a grinding process to reduce the waste plastic material to particles not over about ⅜ inch in size, preferably not over about 3/16 inch in size. Then extrusion is suitably accomplished and the extruded material passed through and over chill rolls and cut to width for the strip.

It sometimes is desirable to conduct the compounding of the composition for the new strip using two steps of blending such as discussed in the Banerjie U.S. Pat. No. 5,030,662 of Jul. 9, 1991, here incorporated by reference. Column 3 of that patent discusses compounding techniques that are especially useful for the beginning step of forming a blend that thereafter, following an initial extrusion, is pelletized or ground, as noted in the Banerjie patent. The ground or pelletized material (preferably not over about 3/16 inch in all dimensions) then is subjected to further processing to convert it into strip form. A suitable technique for that purpose is to extrude the ground or pelletized material under elevated temperature and pressure conditions. The polyolefins are characteristically thermoplastic, and the amount of non-thermoplastic particulate ingredients are preferably kept below about 20 percent by weight, so as to maintain thermoplastic working properties. Because thermoplastic polyolefins have a relatively lower density or weight per unit volume than the particulate fillers or non-thermoplastic materials, a 70 or 75 weight percent of polyolefin content effectively means a polyolefin volume in excess of 70 or 75 percent. It is the nature of thermoplastic materials of the polyolefin family that they become more flowable and fluid as temperature increases. The extrusion processing temperatures should be sufficient to make the plastic flowable even if it may be rather viscous. Such temperatures will generally exceed 300° F. or possibly 350° F., and approach or be around 400° F. or possibly 450° F. The most suitable temperatures are at or around 400° F. where most ethylenic polyolefins melt to a flowable state handleable under extrusion pressure conditions of around 1,000 psi plus or minus a few hundred psi. Such extrusion pressures are useful even when significant quantities up to possibly 15 or 20 percent by weight of paper are present. As paper content is increased, flowability is inhibited and greater difficulty of extrusion is encountered. Thus, it is preferable not to employ paper or other cellulose material contents above about 15 or 20 percent by weight.

The extruded material is suitably passed through and around chill rolls (suitably at about 50°or lower in temperature) to cool the extruded layer and finish its exposed opposing surfaces, following which it is trimmed and wound in overlapping convolutions to form the coil structure of the invention. The surfaces of strips formed in this manner have sometimes been noted to have a wood grain appearance, with one surface (generally the surface that was faster cooled) relatively more smooth than the other or opposite surface.

When the finished strip is to be light in color and even translucent (or possibly approaching transparency), the raw material employed for making it should not include opaque-type materials such as paper or any coloring agents. Generally, however, the raw material of plastic waste is of such a motley character that achieving light colored or translucent strips is passed up as an objective, and dark grey or even black strips are formed by using coloring agents such as carbon black in amounts up to about 1 or 2 percent by weight of the total composition. Carbon black is especially desirable as a coloring agent where chopped or ground particles of plastic-paper structures are included in the composition.

Illustratively, a preferred composition for practicing the invention is one containing a variable ethylenic polyolefin plastic waste content from about 85 weight percent to about 100 weight percent. Paper can account for from 0 to about 14 or 15 percent of the composition weight, and carbon pigment around 1 weight percent. Strips of this composition (e.g., average thickness of 0.033 inch and width of 1¼inches) tested to an average tensile strength of 2,220 psi under the conditions of ASTM:D882-91. The lowest tensile of eight tests was 2,030 psi.

Another useful but less preferred composition was formulated to contain about 80 to 90 percent ethylenic polyolefin plastic. Here the paper content varied between about 10 percent and 20 percent of the weight of the composition, and carbon was used in a small amount (e.g., 1 percent by weight) to color the composition and mask the paper in it. Strips of this composition (e.g., average thickness 0.030 inch and width of 1¼inches) tested to an average tensile strength of 1,670 psi under the conditions of ASTM:D882-91. The lowest tensile of three tests was 1,610 psi.

The significant point is that variation in composition, while still maintaining a substantial and dominant polyolefin content, permits the formation of strip articles having the necessary properties of tear resistance and toughness for a variety of construction uses. Among those uses are the roofing uses. Lath use is particularly noteworthy. Lath is among the cheapest of construction materials and is commonly employed in applications that are not particularly visible—or if visible, not maintained in position for very long. Of course, the lath substitute of this invention is less than ideal for use as the base or matrix for receiving plaster or stucco, but then, current building practices have long not used wood lath for that purpose.

Figure 6:
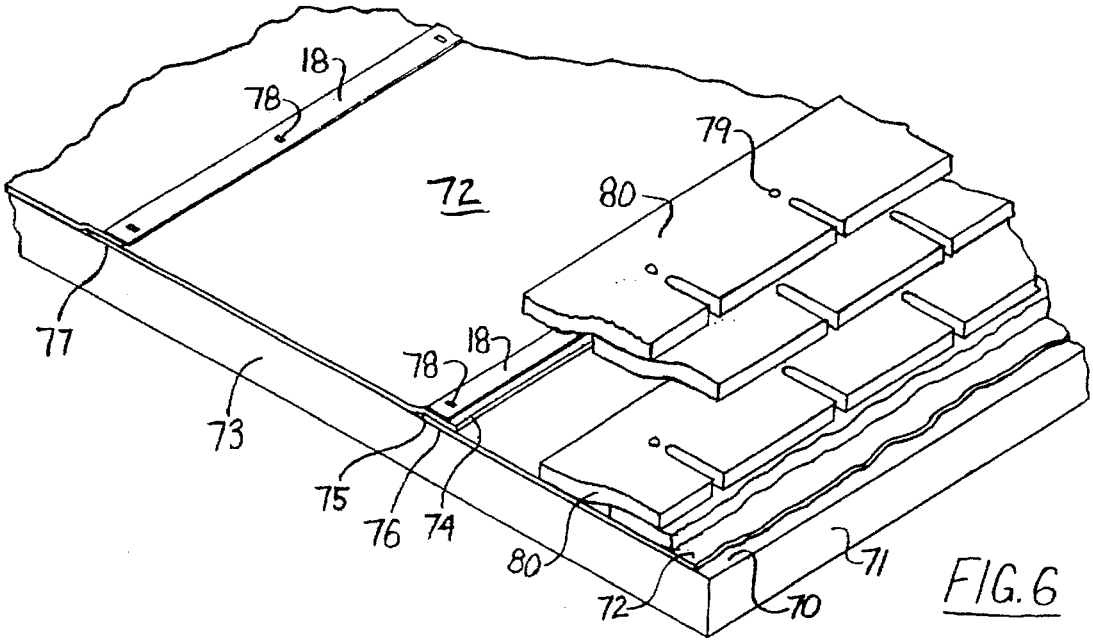
FIG. 6 is a schematic perspective view of an especially significant aspect of the total invention, namely of a new roof structure (shown partially broken away) employing the new plastic construction strip.

A sloped roof structure of the invention as illustrated in FIG. 6 is supported on a sloped roof deck or substrate 70 and is generally comprised of an underlayment layer 72, plastic strips 18, and a final or finish roofing surface layer 80 of conventional overlapped shingles.

The planar roof substrate 70 is suitably formed of plywood sheathing or 6 or 8 inch wide boards. It has a horizontal lower eave edge 71 and typically has an upper ridge edge (not shown) that extends parallel to the lower edge 71. A sloped end edge or rake 73 of deck 70 suitably extends perpendicularly between the upper ridge and lower eave edge 71. The slope of the substrate 70 (e.g., measured along the end edge 73) is preferably at least about 14 degrees above the horizontal, which is sometimes referred to as a "3 in 12" pitch (i.e., a slope having a 3 inch vertical rise for every 12 inches of horizontal run). Preferably the slope should not exceed about 45 degrees (12 in 12); but it may be as great as about 60 degrees (20 in 12), or even more.

The upper surface of the substrate 70 is overlaid with a roofing underlayment layer 72 which is most preferably comprised of roofing felt. The typical roofing felt (also known as tar paper) is an asphalt-impregnated fibrous paper product. It is known to shed water or resist water penetration from its top side but permit moisture under it to pass up through it. Some say that it also functions to stop rain water from penetrating and damaging the roof deck or substrate as well as to form a barrier that prevents finish roofing shingles from coming into contact with moisture or resins in the wood of the roof deck. The felt is available in different weights (e.g., 15, 30, and 90 pounds per 100 square feet of roof surface) having correspondingly different thicknesses, with the 15 and 30 pound felts being generally the most economical and widely used as an underlayment material on sloped roofs. The 15 pound felt is thin (often about 35 mils or less thick). It as well as the 30 pound felt—and even the 90 pound—is susceptible to creasing and breaking if bent back upon itself, and to tearing if it is pulled or twisted as by a hand or finger generated force. Roofing felts exhibit a relatively low tensile strength, believed to be well below 200 psi under conditions of ASTM:D882-91.

Roofing felt is commonly available in a coiled or rolled form of strips having parallel side edges and a width at least about 18 inches and normally about 36 inches. Since the distance from eave to ridge of a roof substrate 70 is usually much greater than the width of the felt, a plurality of felt strips 72 are laid over the substrate 70 with the lateral side edges of each strip oriented generally parallel to the lower roof edge 71. At the meeting of adjacent felt strips, the downroof side edge 74 of the felt strip of higher elevation (on the sloped substrate) overlaps the uproof side edge 75 of the next adjacent lower felt strip by about 2 inches or so (e.g., from 1 to 6 or 8 inches or more, if desired), so that moisture trickling down the upper surface of the higher horizontal felt strip is carried over the side edge 75 of the lower horizontal felt strip. The lapped side edges 74, 75 of adjacent segments form a lap joint 76 extending generally parallel to the horizontal lower edge 71. Mechanical fasteners such as staples or broad-headed nails (e.g., roofing nails) are driven through the felt strips 72 and into the roof substrate 70 at intervals or various locations and particularly at spaced locations or intervals along the joint 76 to secure the felt to the deck. A mechanical fastener spacing along the lap joint 76 may vary from about one per 10 or 12 inches up to about one per yard.

Felt segments 72 on a roof deck 70 are vulnerable to being lifted and torn by winds during times before the final or finish roofing materials are installed over the felt. The overlapping side edge 74 is particularly vulnerable to tearing by wind uplift forces. Thus, the fasteners along the lapped joint 76 are of limited effectiveness in holding down and protecting the side edge 74. It is often difficult or impossible to pull the felt edge 74 taut enough to produce a close abutment of the edges 74, 75 between fastener locations without tearing the felt. The loose portions of the felt edge 74 may be easily lifted away or separated from contact with the underlying surface by the wind. This separation opens a "pocket" beneath the felt for the wind to enter and balloon or billow the felt away from the roof deck 70. The billowing action creates and concentrates large pulling and twisting forces and stresses near the fasteners, and often results in a tear or rip starting at the fastener.

By using the plastic construction strip 18 as a replacement for wood lath, the effectiveness of lath protection is achieved without the problem of removing it before shingling. The strip 18 is most preferably placed to bridge over the overlapping side edge 74 of the lap joint (e.g., to cover the downroof side edge as illustrated at reference numeral 77 in FIG. 6). However, spacing the strip 18 back from the downroof side edge 74 (by not more than about an inch) but still over the lap joint (e.g., as at the lap joint indicated by reference numeral 76) can also be effective. The strip 18 is secured to the roof deck 70 in a relatively taut condition over the lap joints 76, 77 with mechanical fasteners 78 (such as staples or tacks or nails). These fasteners are spaced at intervals along the strip and extend through the strip 18 and the thicknesses of the felt strips of the lap joints into the roof deck or substrate 70.

Installing the plastic strip 18 is most suitably begun at one end of a lap joint 76 (e.g., near the rack end edge 73). The free end of a coil of the plastic strip 18 is placed over the joint 76 and fastened to the roof deck 70 with a fastener 78. A further length of the strip 18 as pulled out from the coil is then tautly held in place over and against the lap joint and stapled down. Felt edges that do not form part of a lap joint but are vulnerable to wind tearing, such as the felt edge along the sloped end edge or rake 73 of the deck 70 or the edge along the lower eave edge 71, may also be protected by mechanically fastening lengths of the plastic strip thereover. Any suitable cutting technique may be used to cut useful lengths of the new plastic strip. Knife cutting is practical.

The new plastic strip 18 protects the felt against wind uplift tearing forces in several ways. The strip deflects a substantial portion of the wind from coming into direct contact with the edge 74 when the strip is positioned to bridge over the downroof side edge. For plastic strips not bridging that edge but nevertheless covering or extending along the lap joint, the relatively taut plastic strip holds the felt against wind uplift because the plastic strip strongly resists upward movement or lifting by the wind. The strip helps to spread the downward force exerted by the fasteners 78 over a greater area of the felt and thus causes better distribution of the stresses in the felt near the plastic strip fasteners. All of this reduces the likelihood of felt tears.

As a result of the decreased vulnerability to wind tearing, roofing felt having the protection of the plastic strip 18 may be left otherwise uncovered and exposed to environmental wind for a longer period of time with a lower risk of damage than has heretofore been the common practice even when wood lath protection has been used.

The finish roofing or top roofing layer 80 is applied directly over the plastic strip protected felt, with the result that the plastic strips are embedded or buried and locked within the roofing structure as a permanent part of it. The finish roofing comprises multiple courses or rows of discrete lapped roofing materials that are designed for and capable of long-term exposure to wind and environmental conditions. The lapped roofing materials may comprise wood or asphalt shingles or the thicker wood shakes or even tile or slate. The most common and economical lapped roofing materials are asphalt shingles. They have an asphalt-covered felt or fiberglass base with a coating of colored mineral granules bonded to the top surface. Typically these shingles are about ⅛ (0.125) inch thick. Each asphalt shingle 80 is laid over the felt segments 12 so that the shingle 80 partially overlaps a lower (on the roof slope) adjacent course of shingles and is partially overlapped by a higher course of shingles. The layer 80 of shingles covers substantially the entire surface of the roof, including the segments 72 of roofing felt with their lapped joints 76, 77 and the plastic strip 18.

The shingles 80 are fastened to the roof deck 70 by any suitable means, including adhesives and/or mechanical fasteners 79 (such as roofing nails). No special variation of fastening is required to accommodate the presence of the embedded plastic strip 18. The strip thus becomes permanently internally incorporated into the structure of the roofing materials. Once laid over the strip and segments of felt, the shingles 80 protect the felt edges 74, 75 and thus supersede the protective function of the strip.

Thus the plastic strip of the invention presents a much more efficient and economical solution to the wind tearing problem than can be achieved using, for example, wood lath. The strip in coiled form and in a dispenser package is exceedingly easy to handle. Apart from the readily apparent time and labor savings gained by eliminating the wood lath removal step (and the discard of the removed lath or transport of it to another job site for reuse), leaving the strip in place on the roof has other advantages. Because the strip is not removed, no holes from removed fasteners are left behind in the felt that may cause potential leakage problems. The strip protects the edges right up to and during the time the shingles are being installed, thus also protecting them from wind damage that may occur during the shingling operation itself.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. An extruded plastic construction strip in the form of a coil of overlapped convolutions, said strip consisting of a blended uniform composition comprised primarily of polyolefin material, said strip being over 100 feet in length and having a substantially uniform thickness between about 20 and 80 mils and a width of at least one-half inch and not over about 12 inches, the structural integrity of said strip being such that it has sufficient resistance to tearing to be substantially untearable under opposing hand forces applied perpendicular to its thickness at an edge starting cut and has sufficient toughness to exhibit a tensile strength in excess of 1,000 psi when tested in accordance with ASTM:D882-91, plus sufficient stiffness to support at least a 6-inch length of itself in upright substantially vertical condition from a holding point and sufficient flexibility to be wound upon itself in overlapping convolutions as small as one inch internal diameter, said coil of overlapped convolutions having adjacent surfaces of the strip in the coil in intimate contact but freely separable during unwinding from said coil, the innermost convolution of said coil having an internal diameter not over about 3 inches and the outermost convolution of said coil having an external diameter in excess of about 10 inches.

2. The coil of claim 1 wherein the innermost convolution has an internal diameter not over about 2 inches and has no core member interiorly of said innermost convolution.

3. The coil of claim 1 wherein said strip is not over about 50 mils thick and the innermost convolution of said coil has a diameter less than about 1 inch.

4. The coil of claim 1 wherein the polyolefin material of said strip comprises waste ethylenic polyolefins.

5. The coil of claim 1 wherein said strip composition includes cellulose fiber material in an amount up to about 25 percent by weight.

6. The coil of claim 5 wherein said cellulose material comprises paper made from wood pulp.

7. The coil of claim 1 as part of a compact package article for shipping and dispensing the plastic construction strip of said coil, said compact package article consisting of said coil and a container having within it said coil, said container having a planar top and bottom wall in substantially flush condition on opposite sides of said coil and having a peripheral wall perpendicularly connecting said top and bottom walls together, said peripheral wall having an exit opening capable of functioning as a dispensing exit for lengths of plastic strip pulled from said coil within said container.

8. The article of claim 7 wherein the coil is coreless.

9. The article of claim 7 wherein said strip is not over about 50 mils thick and the innermost convolution of said coil has a diameter less than about 1 inch.

10. The article of claim 7 wherein the polyolefin material of said strip accounts for at least about 70 percent of the weight of said strip and wherein cellulose material accounts for 0 to about 25 percent of the weight of said strip.

11. The article of claim 10 wherein said cellulose material accounts for at least about 1 percent of the weight of said strip and said cellulose material comprises paper made from wood pulp.

12. The article of claim 7 wherein said strip has a width between about 1 and 3 inches.

13. The article of claim 7 wherein said strip has one opposing surface smoother than the other.

14. The article of claim 7 wherein said container is disposable and is comprised of paperboard.

15. The article of claim 7 wherein said container is formed from paperboard and a fold line in said paperboard defines where said peripheral wall connects to said top wall and another fold line in said paperboard defines where said peripheral wall connects to said bottom wall.

16. The article of claim 7 wherein said peripheral wall comprises a planar peripheral dispensing wall in which said exit opening is located, said planar peripheral dispensing wall additionally having a second opening extending therethrough, said pair of openings being in spaced relationship to each other, each said opening being in the form of a slot aligned in the axis direction of said coil and having a width at least greater than the thickness of said plastic strip, said second opening being an entry opening, the outermost end of said coiled length of plastic strip being threaded through said exit opening and then back through said entry opening so that said outermost end lies loosely within said container but a stretch of said plastic strip extends exteriorly of said container between said exit and entry openings for easy hand gripping to pull the outermost end of said strip from the interior of said container and pull additional length of said strip through said exit opening to cause unwinding of said strip from the coil within the container.

17. The article of claim 16 additionally including a patch of pressure-sensitive adhesive tape temporarily adhered to and forming a bridge between said exterior stretch of said plastic strip and the exterior of said container so as to hold said exterior stretch of plastic strip against lengthwise shifting movement.

18. The coil of claim 1 as part of a compact package article for shipping and dispensing the plastic construction strip of said coil, said compact package article consisting of said coil and a container having within it said coil, said container having a planar top and bottom wall in substantially flush condition on opposite sides of said coil and having a planar peripheral dispensing wall perpendicularly connecting said top and bottom walls together, said planar peripheral dispensing wall having opposite terminal ends and having a pair of parallel slots extending therethrough in spaced relationship to each other and in spaced relationship from each terminal end of said dispensing wall, said slots being aligned in the axis direction of said coil and having a width at least twice the thickness of said plastic strip, one said slot being an exit slot and the other being an entry slot, the outermost end of said coiled length of construction strip being threaded through said exit slot and then back through said entry slot so that said outermost end lies loosely within said container but a stretch of said plastic strip extends exteriorly of said container between said slots for easy hand gripping to pull the outermost end of said strip from the interior of said container and pull additional length of said strip through said exit slot to cause unwinding of said strip from the coil within the container.

19. The article of claim 18 wherein the polyolefin material of said strip accounts for at least about 70 percent of the weight of said strip and wherein cellulose material accounts for zero to about 25 percent of the weight of said strip.

20. The article of claim 19 wherein said cellulose material accounts for at least about 1 percent of the weight of said strip and said cellulose material comprises paper made from wood pulp.

21. A method of installing roofing on a sloped roof substrate having a horizontal lower edge, comprising:

(i) mechanically fastening over said substrate a roofing underlayment comprised of plural roofing felt strips of at least about 18 inches in width having parallel side edges aligned in substantially parallel relationship to the horizontal lower edge of said substrate and having lap joints formed by the downroof side edge of a felt strip of higher elevation overlapping the uproof side edge of the next adjacent lower felt strip on said substrate, the tear resistance of said felt strips being so low that they are vulnerable to tearing damage by wind uplift forces acting particularly on said side edges during times before the finish roofing courses are affixed over said underlayment, (ii) aligning and fastening over said lap joints a flexible plastic strip having a composition comprised primarily of thermoplastic polymeric material and having a tear resistance greater than said felt strip, to thereby provide protection against wind uplift tearing damage for said side edges of said felt strips, said plastic strip having a substantially uniform thickness between about 20 and 80 mils and a width of at least about 1 inch and not over about 12 inches, the structural integrity of said plastic strip being such that it has sufficient resistance to tearing to be substantially untearable under opposing hand forces applied perpendicular to its thickness at an edge starting cut and having sufficient toughness to exhibit a tensile strength in excess of 1,000 psi when tested in accordance with ASTM:D882-91, plus sufficient stiffness to support at least a 6-inch length of itself in upright substantially vertical condition from a holding point and sufficient flexibility to be wound upon itself in overlapping convolutions as small as 3 inches internal diameter, said fastening of said plastic strip over said lap joints being by mechanical fasteners that are spaced along said plastic strip and extend through said plastic strip and the lap joint and penetrate said substrate, and (iii) thereafter fastening lapped courses of finish roofing over said underlayment as well as over said plastic strip so that said plastic strip is permanently embedded and locked within the installed roofing between said roofing underlayment and said lapped courses of finish roofing.

22. The method of claim 21 wherein the polymeric material of said plastic strip is comprised primarily of polyolefin material.

23. The method of claim 21 wherein said step of aligning and fastening said flexible plastic strip over said lap joints is preceded by the step of withdrawing lengths of said plastic strip from a coil thereof.

24. The method of claim 23 wherein at least a portion of the length of said plastic strip withdrawn from said coil is aligned and fastened over a said lap joint while said portion remains connected to the plastic strip of said coil.

25. The method of claim 21 wherein the said step of aligning and fastening said flexible plastic strip over said lap joints is preceded by the step of pulling said plastic strip from a coil thereof through an exit opening of a package article containing said coil.

26. The method of claim 21 wherein the polymeric material of said plastic strip is comprised of polyolefin material accounting for at least about 70 percent of the weight of said plastic strip and wherein cellulose material accounts for 0 to about 25 percent of the weight of said strip.

27. A roofing structure on a sloped roof substrate having a horizontal lower edge, comprising:

(i) a roofing underlayment mechanically fastened at intervals to said substrate, said underlayment being comprised of plural roofing felt strips of at least about 18 inches in width having parallel side edges aligned in substantially parallel relationship to the horizontal lower edge of said substrate and having lap joints formed by the downroof side edge of a felt strip of higher elevation overlapping the uproof side edge of the next adjacent lower felt strip on said substrate, the tear resistance of said felt strips being so low that they are vulnerable to tearing damage by wind uplift forces acting particularly on said side edges during times before courses of finish roofing are affixed over said underlayment, (ii) a flexible plastic strip of a composition comprised primarily of thermoplastic polymeric material aligned and fastened over said lap joints to provide protection for said side edges against wind uplift tearing damage during times before courses of finish roofing are affixed over said underlayment, said plastic strip having a substantially uniform thickness between about 20 and 80 mils and a width of at least about 1 inch and not over about 12 inches, the structural integrity of said plastic strip being such that it has sufficient resistance to tearing to exceed the tear resistance of said felt strips and also to be substantially untearable under opposing hand forces applied perpendicular to its thickness at an edge starting cut and having sufficient toughness to exhibit a tensile strength in excess of 1,000 psi when tested in accordance with ASTM:D882-91, plus sufficient stiffness to support at least a 6-inch length of itself in upright substantially vertical condition from a holding point and sufficient flexibility to be wound upon itself in overlapping convolutions as small as 3 inches internal diameter, said plastic strip being fastened over said lap joints by spaced mechanical fasteners that extend through said plastic strip and the lap joint and penetrate said substrate, and (iii) lapped courses of finish roofing fastened over said underlayment as well as over said plastic strip so that said plastic strip is embedded and locked within the roofing structure between said roofing underlayment and said lapped courses of finish roofing as a permanent part of said roofing structure.

28. The structure of claim 27 wherein the polymeric material of said plastic strip is comprised primarily of polyolefin material.

29. The structure of claim 27 wherein the polymeric material of said plastic strip includes polyolefin material in an amount accounting for at least about 70 percent of the weight of said strip and wherein cellulose material accounts for 0 to about 25 percent of the weight of said strip.

30. The structure of claim 29 wherein said cellulose material accounts for at least about 1 percent of the weight of said strip and said cellulose material comprises paper made from wood pulp.

31. The structure of claim 27 wherein said strip has a width not over about 3 inches.

32. The structure of claim 27 wherein said plastic strip is not over about 50 mils thick.

33. The structure of claim 27 wherein the slope of said roof deck is at least about 14 degrees above the horizontal.

34. The structure of claim 27 wherein said felt strips comprise asphalt-impregnated paper.

35. The structure of claim 27 wherein said plastic strip mechanical fasteners comprise metal staples.

36. The structure of claim 27 wherein said finish roofing comprises asphalt shingles.

* * * * *